United States Patent [19]

Lumpkins

[11] Patent Number: 4,733,745

[45] Date of Patent: Mar. 29, 1988

[54] ADJUSTABLE CONTROL ATTACHMENT FOR AN EARTH MOVING VEHICLE

[75] Inventor: George T. Lumpkins, Katy, Tex.

[73] Assignee: Machinery Distribution, Inc., Houston, Tex.

[21] Appl. No.: 862,955

[22] Filed: May 14, 1986

[51] Int. Cl.[4] ..... B60K 29/00

[52] U.S. Cl. ..... 180/315; 74/493; 280/775

[58] Field of Search ..... 180/315, 78, 320; 174/65 R; 74/492, 493, 495; 280/775

[56] References Cited

U.S. PATENT DOCUMENTS

| | | | |
|---|---|---|---|
| Re. 31,646 | 8/1984 | Beals et al. | 180/78 |
| 4,365,687 | 12/1982 | Baver | 180/315 |
| 4,449,419 | 5/1984 | Brugvera | 280/775 |
| 4,458,776 | 7/1984 | Wagner | 180/315 |
| 4,580,647 | 4/1986 | Peifer | 280/775 |
| 4,664,220 | 5/1987 | Ruhter et al. | 180/315 |
| 4,664,221 | 5/1987 | Loney et al. | 180/334 |

*Primary Examiner*—Richard A. Bertsch

*Attorney, Agent, or Firm*—Fulbright & Jaworski

[57] ABSTRACT

An adjustable control attachment includes a pivot plate pivotally attached to each side of a control console with a control lever shaft connected and movable with each pivot plate. A plurality of control levers are pivotally mounted on each shaft and a flexible control cable is connected to each lever and adapted to be connected to a hydraulic control valve. A cable supporting bracket is connected to each of the pivot plates and is connected to and supports the control cables. A control actuating rod is pivotally connected between the vehicle and each of the pivot plates for creating an elliptical movement of the controls as the console is moved.

9 Claims, 4 Drawing Figures

ADJUSTABLE CONTROL ATTACHMENT FOR AN EARTH MOVING VEHICLE

BACKGROUND OF THE INVENTION

It is conventional to provide a movable control console and steering wheel on an earth moving vehicle such as a motor grader which is movable forward and backward to position the steering wheel relative to the vehicle operator. The adjustment of the control console may be a single pivot connection or a parallelogram linkage as shown in U.S. Pat. No. RE 31,646.

Generally, other types of vehicle controls are mounted on the side of the control console and move with the console. However, various types of vehicles have different position patterns which makes it difficult for an operator to move from one type of vehicle to another without requiring a training or transition period. In fact, many vehicles have rigid types of control connections which prevent the operating pattern of the control levers to be changed or standardized. Furthermore, any forward or backward adjustment of the position of the control console may result in an undesirable change in the positioning of the other controls relative to the operator.

The present invention is generally directed to an adjustable control attachment for use on a earth moving vehicle, with either a movable or a fixed steering console, which can provide a universal or standard position pattern for the control levers so that an operator can easily and safety move from one machine to a different machine with a minimum time required to become skilled, and in which the control pattern can be changed to any desired operating pattern by easily changing the connection of the controls to the main hydraulic control valves or at the control console. In addition, a simple rod assembly rotation is provided to give the best accessibility for the control levers when the console is in either a rearward position with the operator sitting or in a forward position with the operator standing or exiting the vehicle.

SUMMARY

The present invention is directed to an adjustable control attachment for use on an earth moving vehicle having hydraulic control valves and a control console pivotally connected to the vehicle for supporting a steering wheel. A pivot plate is pivotally attached to each side of the control console and a control lever shaft is connected to and movable with each pivot plate. A plurality of control levers are pivotally mounted on each shaft and a flexible control cable is connected to each control lever and is adapted to be connected to one of the hydraulic control valves. This structure allows the flexible control cables to be suitably connected between the control levers and the hydraulic control valves to provide any desired position pattern.

A further object is the provision of an adjustable control attachment for use on a fixed control console in which the attachment may be manually rotated and manually locked in place.

A further object is the provision of an adjustable control attachment for use on a control console which is pivotally connected to the vehicle for forward and backward movement. A control actuating rod is pivotally connected between the vehicle and each of the pivot plates for automatically rotating the pivot plates and the control levers in an elliptical path when the control console is pivoted relative to the vehicle.

Still a further object of the present invention is wherein a cable supporting bracket is connected to each of the pivot plates and is connected to and supports the control cables whereby the control pattern can be changed to any desired operating pattern by changing the connection of the control cables to the hydraulic control valves or to different control levers.

Still a further object of the present invention is wherein the pivot connection of the pivot plates to the console is above the pivot connection of the actuating rod to the pivot plates whereby the control lever shaft and control levers will rotate forward and down when the console is moved forward and will rotate backwards and up to better position the levers when the console is moved backward.

Yet a further object of the present invention is the provision of at least one arcuate slot and pin connection between each of the pivot plates and the console for allowing rotation of the plates relative to the console but supporting the plates during rotation.

A still further object of the present invention is the provision of an adjustable control attachment including a pivot plate pivotally attached to each side of the control console, a control lever fixedly connected and movable with each pivot plate and having a plurality of control levers, a push-pull type flexible control cable connected to each control lever and a cable supporting bracket fixedly connected to each of the pivot plates and positioned parallel to the lever shaft. The flexible control cable includes an outer covering connected to the supporting bracket and an inner wire connected to the control lever. A control actuating rod pivotally connected between a vehicle support bracket and each of the pivot plates rotates all of the levers and the cable connections as a unit.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENTS

While the present invention will be described, for purposes of illustration only, for use on one type of pivoting control console, it is to be understood that the present invention may be useful and applied to other types of pivoting and fixed control consoles.

Figure 1:
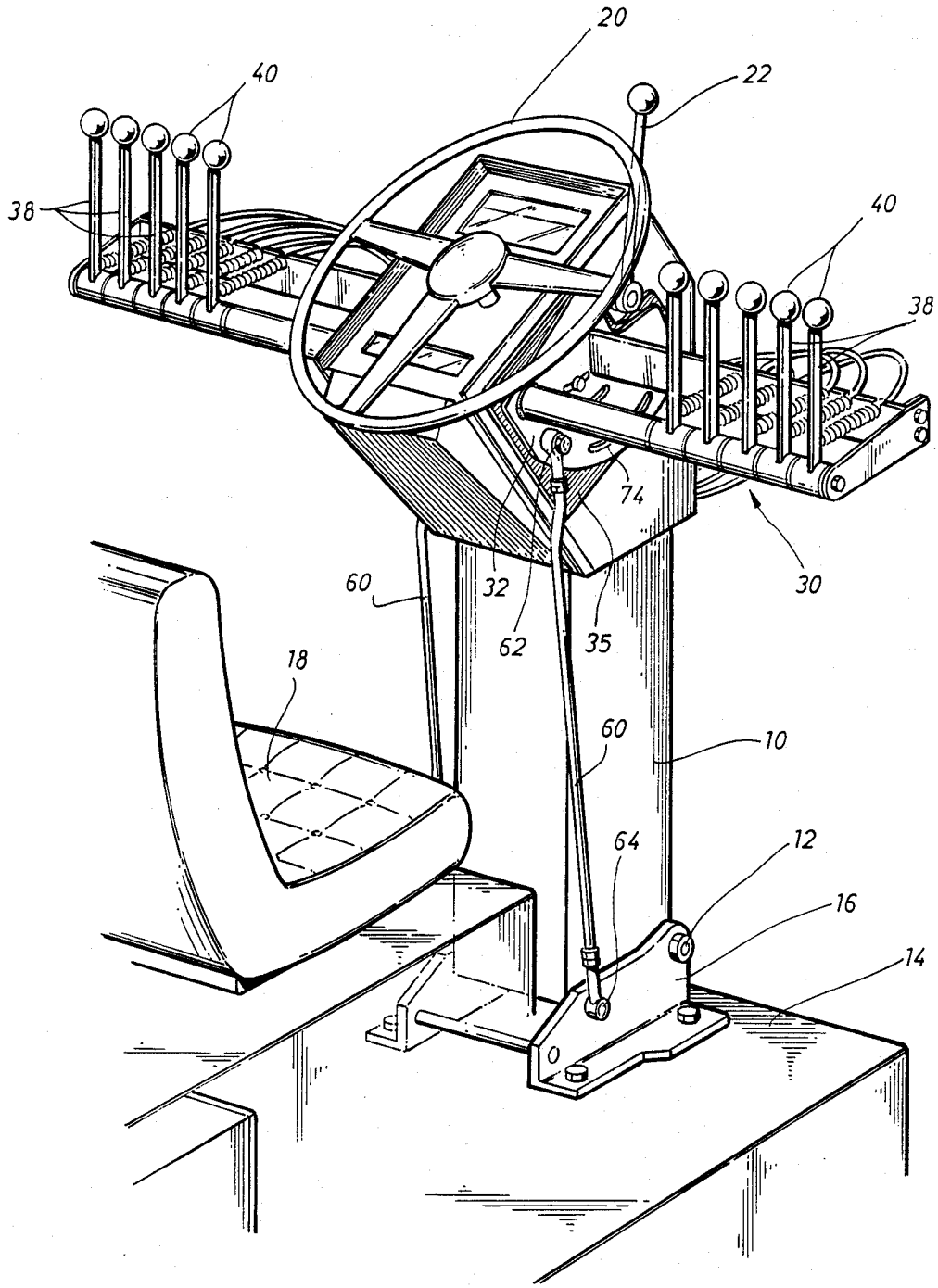
FIG. 1 is an elevational fragmentary perspective view of the present invention shown at the operator's position in an earth moving vehicle.

Referring now to FIG. 1, a control console generally indicated by the reference numeral 10 is shown which is pivotally connected at pivot 12 to the floor 14 of a conventional earth moving vehicle such as to a support bracket 16 in position in front of the operator seat 18. The console 10 supports a steering wheel 20. The console 10 may be pivoted about the pivot connection 12 in either a forward or backward position relative to the seat 18 and released or locked in any desired position by releasable locking lever 22.

The foregoing description of the control console 10 is of a conventional console used on a Mitsubitsi road grader. Such a road grader includes a plurality of hydraulic control valves (not shown) for controlling various functions such as blade hoist, wheel lean, articulation, blade hoist, scarifier and other conventional functions.

It has been conventional to connect various types of control levers on the sides of the console 10 for actuating the various hydraulic control valves. However, the location and positioning of the various control levers has differed from one machine manufacturer's model to another. Thus an operator was required to learn and actuate a new control lever positioning pattern as he changed from one machine to another before he could become skilled and proficient at operating the new machine. Furthermore, the control lever locations and patterns on various types of vehicles were frequently controlled by rigid linkages which cannot be easily changed to provide a standard or universal control lever pattern system. In addition, the control levers, since they were attached to the movable console, are moved with the change in position of the console, and may result in an undesirable change of the control levers relative to the operator as the console 10 and steering wheel 20 is moved.

Referring now to the drawings, the reference numeral 30 generally represents the adjustable control attachment of the present invention which provides a universal control system for use on an earth moving vehicle such as the motor grader so that (1) the operator can easily and safety move from one machine manufacturer's model to another with a minimum time required to become skilled with the new machine, (2) the control position or pattern of the control levers can be changed to any operating pattern for standardizing the pattern merely by moving the connections of flexible control cables to either the hydraulic control valves or to the control levers, and (3) the adjustable control attachment automatically moves, as the console 10 is moved, to accomplish the best positioning of the control levers for operation by the operator.

The adjustable control attachment 30 includes a pivot plate 32 pivotally attached to each side of the control console 10 by a pivot pin 34. Preferably, a base plate 35 is provided between the side of the console 10 and each pivot plate 32. A control lever shaft 36 is fixedly connected to each of the pivot plates 32, such as by welding, and is preferably perpendicular to the pivot plate 32. A plurality of control levers 38 are pivotally mounted on each shaft 36 and manually controlled by a hand knob 40. Any desired number of control levers 38 may be provided on each shaft 36 and the number may be changed as required. A push pull type flexible control cable 41 consisting of an outer covering 42 and an inner wire is provided with the inner wire connected to a fastener 44 and to one of the control levers 38 through a slot 46.

A cable supporting bracket 48 is also fixedly connected to each of the pivot plates 32 and positioned parallel to the lever shaft 36 and is connected to and supports the outer covering 42 of the control cable. The bracket 48 includes a plurality of openings 50 for receiving an adjustable fastener 52 for locking the control cable 41 in an opening 50. The other ends of the control cables are adapted to be connected to one of the hydraulic control valves on the vehicle. Actuation of the hand knob 40 will therefore actuate the control cable to control the desired hydraulic control valve. An end support plate 51 may be secured to the outer ends of the shaft 36 and bracket 48.

It is to be noted that the control pattern or operating function of the various control levers 38 can be quickly and easily changed to any desired operating pattern merely by moving the connection of the control cables 41 to a desired opening 50 and connecting the fastener 44 to the desired lever 38. Additionally, the other end of the control cable 41 may also be moved to control the desired hydraulic control valve.

As will be more fully described hereinafter, when the console 10 moves the pivot plates 32 are also rotated. However, since both the control shaft 36 and support bracket 48 and cable connection moves as a unit only the control cable 41 spaced from the bracket 48 need to flex to accommodate such a movement. Therefore, any required change in the operating connection of any cable 41 to a control lever 38 to acquire a desired operating pattern can be accomplished without interferring with the rotation of the pivot plate 32.

A control actuating rod 60 is pivotally connected between each of the pivot plates 32 at a pivot point 62 and the vehicle such as the support bracket 16 at a pivot point 64 for rotating the pivot plates 32 and the control levers 38 when the control console 10 is pivoted relative to the support bracket 16. The rotation of the pivot plates 32 and the control levers 38 occurs automatically when the operator moves the control console 10 forward or back.

The purpose of rotation of the levers 38 is to provide the best accessibility for the levers 38 when the console is rearward and the operator is sitting in the seat 18 or when the control levers 38 are forward and the operator is standing or exiting the vehicle. To provide the best positioning, the control levers 38, containing all of the levers 38 and control cable attachments, rotates forward and down when the console 10 moves forward. The control levers 38 rotate backward and upward when the control console 10 moves backward to better position the control levers 38 when the operator is sitting in the seat 18.

Figure 3:
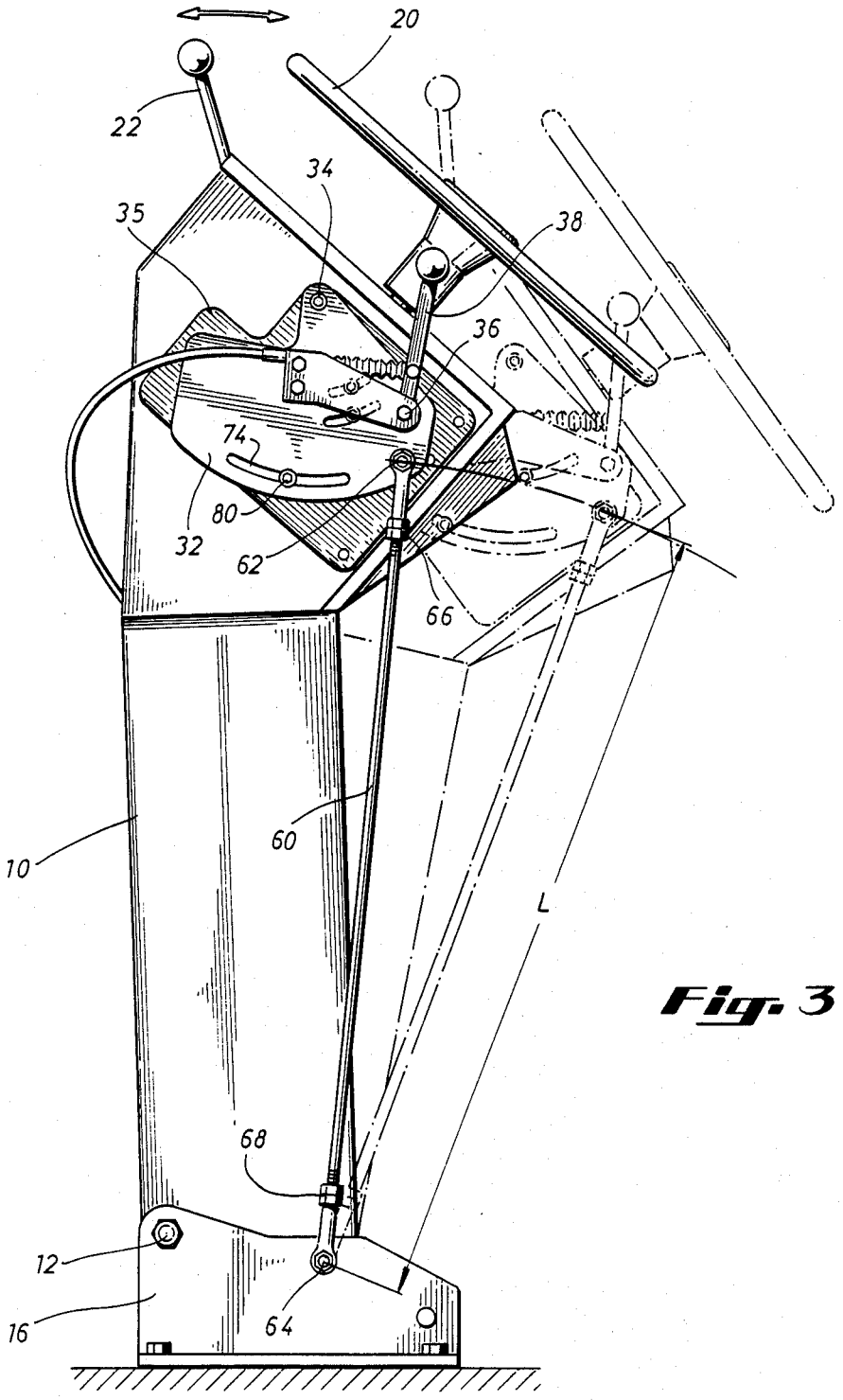
FIG. 3 is an enlarged elevational view showing the operation of the present invention in both a forward and backward position.

Referring now to FIG. 3, the control console 10 moves in a circular path about the pivot point 12. Thus, the pivot point 34 for the pivoting plates 32 also moves in a circular path. The pivot connection 62 of the actuating rod moves in a circular path about the pivot connection 64 of the actuating rod 60 to the bracket 16. However, as the pivot point 32 is above the pivot point 62, the motion of the control lever shaft 36 and thus of the levers 38 creates an elliptical movement with reference to the vehicle.

The actuating rod 60 may include adjustable connections 66 and 68 at each end for lengthening or shortening the rods 60 between the pivoting plate 32 and the bracket 16 for adjusting the desired final position of the control levers 38.

Figure 2A:
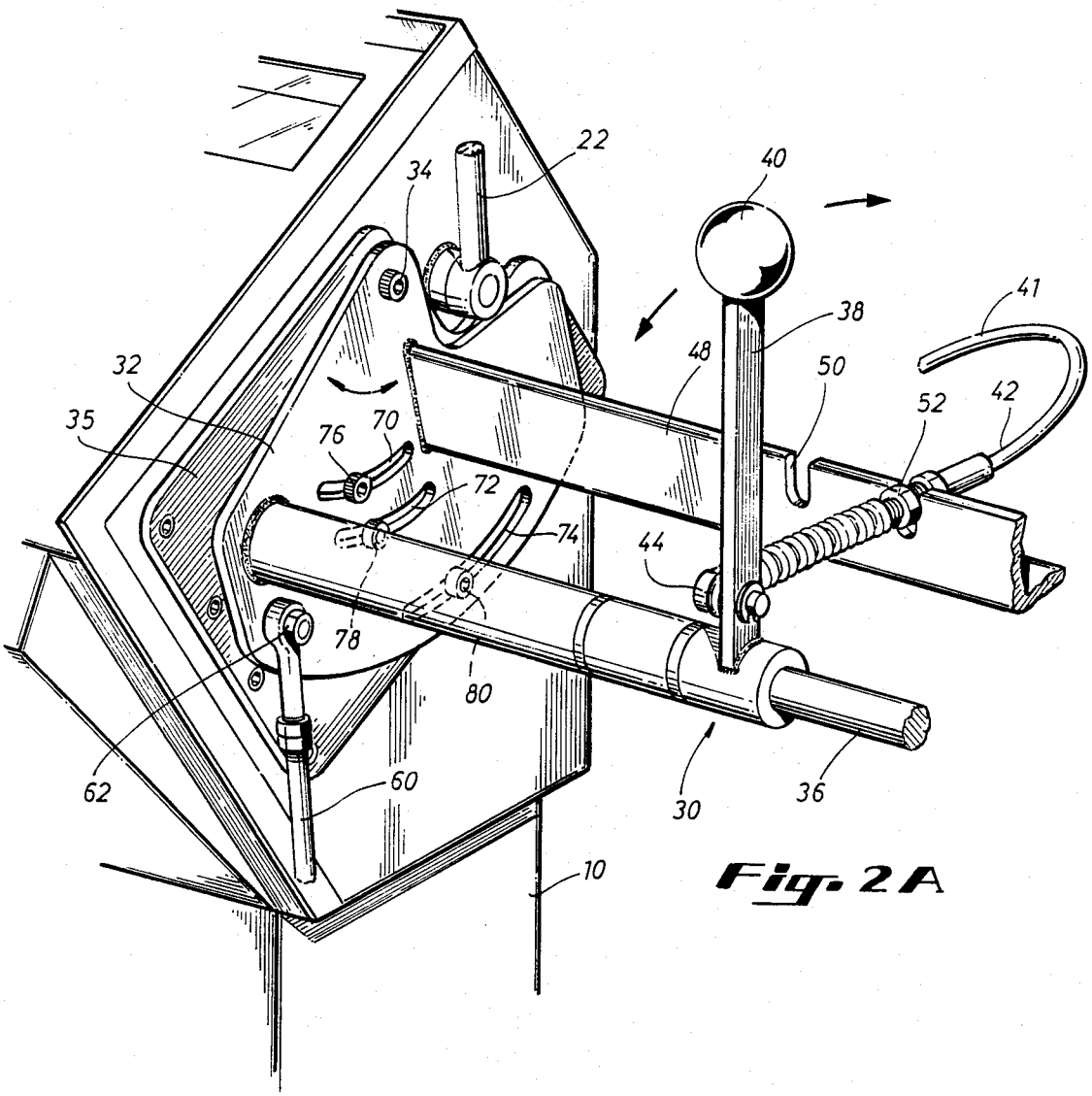
FIGS. 2A and 2B are continuations of each other and are enlarged perspective and fragmentary views of the adjustable control attachment of the present invention.
Figure 2B:
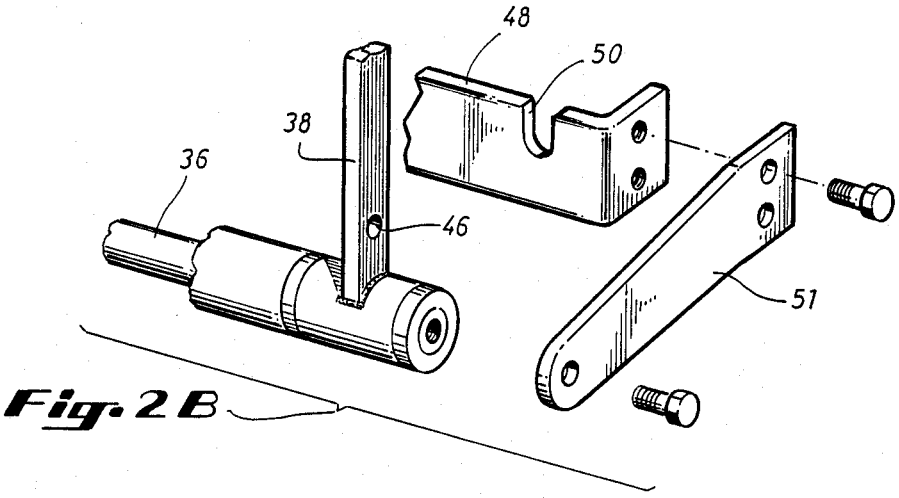

As best seen in FIG. 2A, at least one, and preferably three, arcuate slots 70, 72 and 74 and coacting pins 76, 78 and 80, respectively, are provided between the pivot plates 32 and the console 10 for allowing rotation of the plates 32 relative to the console 10, but securely supporting said plates 32 during the rotation.

Therefore, in use, as the console 10 and steering wheel 20 is moved forward or backward by use of the releasable locking lever 22, the actuating rod 60 automatically provides the force to pivot the pivot plates 32 and automatically brings the control levers 3 into the desired operating position depending upon movement of the console 10.

The adjustable control attachment 30 may also be used on a console 10 which is fixed relative to the vehicle. That is, referring to FIG. 2A, the actuating rod 60 may be omitted and the plate 32 may be manually moved about the pivot 34 by the operator to the desired rotative position. One of the pins such as 80 may be screwed down for then locking the plate 32 in the desired position. Whenever it is desired to change the position of the plate 32, the pin 80 is loosened, the plate 32 rotated, and the pin 80 is again tightened.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. An adjustable control attachment for an earth moving vehicle having hydraulic valves and having a control console connected to the vehicle for supporting a steering wheel comprising, said console being a rigid member pivotally connected to the floor of the vehicle, first and second pivot plates and one of said plates pivotally attached to each side of the control console for rotation of the plates relative to the console, means between the console and the plates for releasably locking the pivot plates to the control console, a control lever shaft fixedly connected to and movable with each pivot plate, a plurality of control levers pivotally mounted on each shaft, a push-pull type flexible control cable connected to each control lever and adapted to be connected to one of the hydraulic control valves, a cable supporting bracket fixedly connected to each of the pivot plates and positioned parallel to said lever shaft and connected to and supporting the control cables.

2. An adjustable control attachment for use on an earth moving vehicle having hydraulic control valves and a control console pivotally connected to the vehicle for forward and backward movement and supporting a steering wheel comprising, said console being a rigid member pivotally connected to the floor of the vehicle, first and second pivot plates, and one of said plates pivotally attached to each side of the control console, a control lever shaft connected to and movable with each pivot plate, a plurality of control levers pivotally mounted on each shaft, a flexible control cable connected to each control lever and adapted to be connected to one of the hydraulic control valves, and a control actuating rod pivotally connected between the vehicle and each of the pivot plates for rotating the pivot plates and control levers when the control console is pivoted relative to the vehicle.

3. The apparatus of claim 2 including, a cable supporting bracket connected to each of the pivot plates and connected to and supporting the control cables.

4. The apparatus of claim 2 wherein the pivot connection of the pivot plates to the console is above the pivot connection of the actuating rod to the pivot plates.

5. The apparatus of claim 2 including, an arcuate slot and pin connection between each of the pivot plates and the console for allowing rotation of the plates relative to the console but supporting said plates during rotation.

6. An adjustable control attachment for an earth moving vehicle having hydralic control valves and having a control console pivotally connected to a vehicle support bracket for forward and backward movement and supporting a steering wheel comprising, said console being a rigid member pivotally connected to the support bracket, first and second pivot plates, and one of the plates pivotally attached to each side of the control console, a control lever shaft fixedly connected to and movable with each pivot plate, a plurality of control levers pivotally mounted on each shaft, a push-pull type flexible control cable connected to each control lever and adapted to be connected to one of the hydraulic control valves, a cable supporting bracket fixedly connected to each of the pivot plates and positioned parallel to said lever shaft and connected to and supporting the control cables, a control actuating rod pivotally connected between the vehicle support bracket and each of the pivot plates for rotating the pivot plates and said control levers when the control console is pivoted relative to the support bracket.

7. The apparatus of claim 6 wherein the flexible control cable includes an outer covering connected to the supporting bracket and an inner wire connected to a control lever.

8. The apparatus of claim 7 wherein the pivot connection of the pivot plates to the console is above the pivot connection of the actuating rod to the pivot plates.

9. The apparatus of claim 8 including, at least one arcuate slot and pin connection between each of the pivot plates and console for allowing rotation of the plates relative to the console but supporting said plates during rotation.

* * * * *